US006725609B2

(12) United States Patent
Freiborg et al.

(10) Patent No.: US 6,725,609 B2
(45) **Date of Patent: *Apr. 27, 2004**

(54) FOLDED RIDGE COVER AND METHOD OF FABRICATION

(75) Inventors: Mark Freiborg, Huntington Beach, CA (US); Bennie Freiborg, Flintridge, CA (US)

(73) Assignee: The Dorothy and Ben Freiborg 1980 Trust, by said Ben Freiborg, Flintridge, CA (US)

( * ) Notice: Subject to any disclaimer, the term of this patent is extended or adjusted under 35 U.S.C. 154(b) by 1 day.

This patent is subject to a terminal disclaimer.

(21) Appl. No.: 09/931,197

(22) Filed: Aug. 16, 2001

(65) Prior Publication Data

US 2002/0000068 A1 Jan. 3, 2002

Related U.S. Application Data

(63) Continuation-in-part of application No. 09/433,810, filed on Nov. 3, 1999, which is a continuation-in-part of application No. 09/264,155, filed on Mar. 5, 1999, now Pat. No. 6,182,400.

(51) Int. Cl.[7] ..... E04B 7/02

(52) U.S. Cl. ..... 52/57; 52/276; 52/518; 52/557

(58) Field of Search ..... 52/57, 276, 518, 52/557, 559, 745.19, 278, 560, 526, 525, 528

(56) References Cited

U.S. PATENT DOCUMENTS

| | | | | | |
|---|---|---|---|---|---|
| 1,387,235 | A | * | 8/1921 | Burkhardt | 52/57 |
| 2,230,922 | A | * | 2/1941 | Young | 52/57 |
| 2,568,469 | A | * | 9/1951 | Sunderhauf | 52/557 |
| 2,619,855 | A | * | 12/1952 | Williams | 52/45.19 |
| 2,849,757 | A | * | 9/1958 | Meldrum | 52/560 |
| 3,913,294 | A | | 10/1975 | Freiborg | |
| 4,187,650 | A | * | 2/1980 | Poplin | 52/57 |
| 4,434,589 | A | | 3/1984 | Freiborg | |
| 4,439,955 | A | | 4/1984 | Freiborg | |
| 4,447,500 | A | | 5/1984 | Ferris | |
| 4,824,880 | A | | 4/1989 | Algrim et al. | |
| 4,897,293 | A | | 1/1990 | Thessen | |
| 4,923,913 | A | | 5/1990 | Chich et al. | |
| 5,094,042 | A | | 3/1992 | Freborg | |
| 5,295,340 | A | | 3/1994 | Collins | |
| 5,319,898 | A | | 6/1994 | Freiborg | |
| 5,365,711 | A | | 11/1994 | Pressutti | |
| 5,375,388 | A | | 12/1994 | Poplin | |
| 5,377,459 | A | | 1/1995 | Freiborg | |
| 5,471,801 | A | | 12/1995 | Kupczyk | |
| 5,636,490 | A | * | 6/1997 | Stocksieker | 52/556 |
| 5,685,117 | A | | 11/1997 | Nicholson | |

FOREIGN PATENT DOCUMENTS

| | | | | |
|---|---|---|---|---|
| DE | 19529900 | * | 2/1996 | 52/557 |
| EP | 1083272 | * | 3/2001 | 52/557 |
| JP | 110243 | * | 5/1991 | 52/526 |

* cited by examiner

*Primary Examiner*—Lanna Mai
*Assistant Examiner*—Phi Dieu Tran A
(74) *Attorney, Agent, or Firm*—Blakely, Sokoloff, Taylor & Zafman LLP

(57) ABSTRACT

Asphalt composition ridge cover formed from an approximately rectangular sheet of asphalt composition roofing material. The sheet of asphalt composition material is bent around a radius through approximately a ninety degree angle along the centerline so that no more than minimal bending of the ridge cover is required during later installation. The roofing material may be bent by pressing the roofing material into a resilient pad with a tool having the radius while the roofing material is heated

17 Claims, 4 Drawing Sheets

FOLDED RIDGE COVER AND METHOD OF FABRICATION

CROSS-REFERENCE TO RELATED APPLICATIONS

This application is a continuation-in-part of application Ser. No. 09/433,810 filed Nov. 3, 1999, pending, which is a continuation-in-part of application Ser. No. 09/264,155 filed Mar. 5, 1999, now U.S. Pat. No. 6,182,400.

FIELD OF THE INVENTION

This invention relates to the field of roofing, and more particularly to preformed asphalt composition roof ridge, hip, and rake covers.

BACKGROUND OF THE INVENTION

Various types of roofing and, in particular, ridge covers, are well known in the prior art. In general, the ridge cover selected for use on a particular roof is selected in conjunction with the shingle or other roof covering, as part of the roofing system. Consequently, in the following discussion of the prior art, the considerations in choice of the roofing system will be described, it being understood that a ridge cover is generally selected for comparability in appearance and installation with a complete roofing system. Also, the present invention ridge cover is particularly advantageous because of its appearance and, therefore, the following discussion of prior art is limited to those applications where appearance is a substantial consideration.

Prior art roofing systems include asphalt composition shingles, tile roofs, rock roofs (decorative rock scattered over an asphalt covered asphalt composition sheet) and shake roofs. In general, each of these types have certain features and disadvantages and the choice for any particular installation is generally a compromise to achieve the desired results. By way of example, a tile roof may be a very attractive roof, but it is both an expensive and a heavy roofing material, typically weighing as much as 900 pounds per 100 square feet. The weight of such roofs may require that the roof structure itself be increased over that which would be used with another type of roofing material and, consequently, the cost associated with tile roofs may include an incremental cost due to the increases of structural requirements in the building itself. Such roofs, however, are both durable and attractive and are used where these are prime considerations. Also, in some areas of the country where there is a substantial hazard of fire due to hot ashes originating from nearby brush fire such roofs are used because they are fire proof.

Rock roofs are often used for homes in some parts of the country and are a reasonable good compromise between cost and appearance. This type of roof is generally limited to low pitch roofs since the rocks are not all physically secured to the underlying asphalt. Also, the rocks tend to become scattered with time because of the effects of high winds, heavy rains or the sweeping effect of branches on neighboring trees and, therefore, must be replaced or replenished occasionally to maintain the desired appearance.

Shake roofs are roofs made up of tapered wooden strips nailed to the roof much like shingles and are popular in parts of this country because of their highly attractive appearance and because they esthetically conform to many types of building construction. This type of roof is somewhat less expensive than a tile roof and is much lighter, characteristically having weights of approximately 450 pounds per 100 square feet. However, such a roof is not as durable as most other types of roofs since it is subjected to deterioration from environmental exposure and the individual wooden members are apt to crack when walked on, and to thereafter leak.

Furthermore, unless specially treated such roofs are highly inflammable and create a substantial fire hazard whenever the roof may be exposed to hot ashes originating from a neighboring fire.

An asphalt composition roof made up of individual shingles is a relatively durable, light-weight and inexpensive roof. Such a roof may have a weight of approximately 235 pounds per hundred square feet and is fairly easily and quickly installed. The asphalt is not easily ignited and fire resulting from hot ashes falling on the roof is further inhibited by the granular surface on such roofs. However, this type of roof is a very flat and bland type of roof, the shingles having little thickness and distinctive character to create an attractive appearance. Though such shingles may be made with a variety of color granules on the surface, thereby creating a reasonable choice of colors for the final roof, and the individual shingles create a reasonably attractive pattern on the roof, such a roof is a roof with pattern and color without dimension, since the individual shingles are only on the order of one-eighth to three-sixteenths of an inch thick, and little depth or dimension is given by the overlap of one shingle by another. Consequently, though the appearance is the only substantial negative factor associated with such roofs, they are not commonly used in installation where considerations of appearance outweigh considerations of cost. The use of asphalt composition ridge covers fabricated to increase the thickness of the exposed overlapping end can improve the overall appearance of an asphalt composition roof by creating a dimensional appearance. An example of such an asphalt composition ridge cover is provided in U.S. Pat. No. 6,182,400 issued to the inventors of the present invention.

Asphalt composition material is prone to cracking when folded. Cracking in ridge covers along the fold forming the ridge line is a persistent problem in asphalt composition ridge covers. It is desirable to provide asphalt composition ridge covers that are less susceptible to cracking along the ridge line.

SUMMARY OF THE INVENTION

The present invention is employed in the fabrication of asphalt composition ridge covers to create an appearance similar to that of a shake shingle roof. The invention generally comprises a ridge cover which is formed by folding a plurality of tabs of a pair of unfolded ridge covers over one another to create a ridge cover which gradually thickens as one proceeds from the back of the ridge cover toward the front of the ridge cover.

The first ridge cover is placed on the roof ridge in a normal manner. The second ridge cover is placed on the first such that the front end is set back about eight inches from the front end of the first ridge cover. Each additional ridge cover is deployed in a manner similar to the preceding ridge cover. The ridge covers appear, at the exposed end, about 5 to 7 times as thick as the conventional asphalt shingle, creating an attractive appearance by adding a dimensional characteristic to the ridge cover while maintaining full double coverage. A suitable adhesive may be used to facilitate installation.

In the presently preferred embodiment, the increased thickness is formed by folding multiple tabs on one end of each of two pieces which are placed and sized such that when all folds are completed, the desired thickened end is produced. The two pieces are adhesively joined to maintain the desired configuration of the folded tabs while leaving the area adjacent to the longitudinal centerline free of adhesive. The assembled ridge cover is bent around a radius along its longitudinal centerline to form about a ninety degree angle. When the longitudinal bend is completed, the ridge cover then has the proper shape for installation on a ridge. A solid filler material, such as ground rubber particles, may be mixed with the adhesive so that the adhesive joint increases the thickness of the assembled ridge cover. The rounded bend at the centerline fold and the absence of adhesive provides a pliable fold without stress concentrations. The resulting pre-folded ridge cover is less susceptible to cracking along the centerline fold.

The shape and construction of the folded ridge cover allows the folded covers to be economically packed for shipping. One particular shape of the unfolded cover pieces permits a very economical cutting of such covers from rectangles of asphalt composition material of industry standard dimensions.

DETAILED DESCRIPTION OF THE INVENTION

Figure 1:
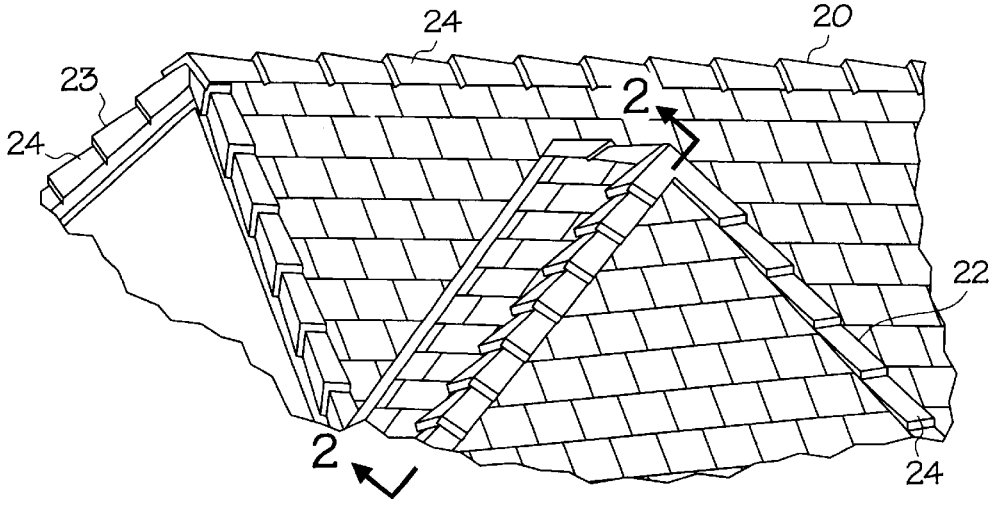
FIG. 1 is a drawing of a portion of a building roof illustrating the appearance of the ridge cover of the present invention.

First referring to FIG. 1, an illustration of the present invention ridge cover 24, as installed on a typical roof, may be seen. It is to be understood that the phrase ridge cover, as used herein, is used in the broad sense to include hip covers, rake pieces, and the like, and is used merely as a convenient phrase for identifying all such covers. Such covers may be applied along a ridge line 20, a hip line 22, a rake line 23, or generally at any intersection of two roof planes or edge of a roof plane.

In its simplest form, a ridge cover for an asphalt composition roof can be an approximately rectangular sheet of roofing material bent along its centerline to substantially the same angle as the angle formed by the roofing surfaces where they meet at the ridge line of the roof. In the description herein and as used in the claims, the phrase "approximately rectangular" is used to distinguish from round, oval, triangular or other shapes departing substantially from a rectangular shape, and includes among other shapes, truly rectangular shapes, four sided shapes wherein two opposite sides are parallel and the other two sides are somewhat non parallel so as to define a member having a somewhat tapered width, and a stepped shape as shown in the Figures herein (see FIGS. 2 through 7).

Also the asphalt composition roofing material is characterized by a mat or roving of fibrous material typically saturated with asphalt, and having a layer of asphalt bonding inorganic granules to the top surface of the roofing material. The mat may be an organic mat, or an inorganic mat such as a fiberglass mat, and the asphalt may have or include a modifier, locally or throughout, to make the material more flexible, particularly in cold weather, though one of the features of the present invention is the minimization of the bending of the ridge cover required on installation, thereby substantially eliminating the advantage of a flexiblizer. Generally the selection of the mat material, the granule color, etc. will be coordinated with the same parameters for the shingles on the roof for overall physical and visual compatibility.

It will be appreciated that when any material is bent, the outer surface of the bend is placed in tension and the inner surface is compressed. It will also be appreciated that asphalt composition roofing material is a complex elastomeric material with non-uniform properties with behavior that is not accurately described with reference to models based on ideal materials. Nonetheless, it is known that asphalt composition roofing material is susceptible to cracking along lines where it has been bent. Cracking may occur during the bending operation or later when the material ages or is exposed to adverse conditions. Asphalt composition roofing material becomes brittle when cold and it can be virtually impossible to bend without material failure at temperatures that can be encountered when installing a roof, particularly if the ambient temperatures is below 50° F. While asphalt composition ridge covers can be made at the time of roofing installation either from specially cut material that is folded by the installer or from field shingle material that is cut and folded by the installer, bending and folding at the time of installation produces ridge covers that are highly susceptible to cracking along the folds and bends.

The present invention provides asphalt composition ridge covers that are less susceptible to cracking along the folds and bends by providing a ridge cover that is preformed so that only minimal bending of the ridge cover is required during later installation. There are a number of aspects of the inventive ridge cover that are believed to contribute to the improved characteristics of resistance to cracking. The bend through approximately 90 degrees that forms the ridge line is the most important bend in terms of overall durability of the ridge cover as a part of the roofing system. The inventive ridge cover makes this bend around a radius to produce less tension on the outer surface of the bend. Preferably the bending and folding are done at elevated temperatures to improve the elasticity of the material during these operations. Preferably the bending along the ridge line is done by an impact forming method described below to improve the characteristics of the material in the bent region. It has been found that a ridge cover manufactured with a preformed bend according to the invention exhibits improved durability along the ridge line as compared to other ridge covers, and particularly as compared to ridge covers that are bent or folded at the time of installation.

In the description herein and as used in the claims, the phrase "bent around a radius" is used to mean a bend that is formed such that the inner surface of the bent material has a substantial radius as compared to the thickness of the material such that the tension introduced in the outside surface of the bent material is substantially less than it would be if the material were bent over a sharp edge. Asphalt composition roofing material typically has a thickness of about one-eighth to three-sixteenths of an inch. A bending radius of one-fourth inch has been found to be satisfactory for bending ridge covers made from a double thickness of roofing material.

It has been found that the ridge line bend may be advantageously formed by an impact forming method. A cross section of a ridge cover 90 made from a double thickness of roofing material 92, 94 is shown during impact forming in FIG. 9. The outer surface 93 of the unbent ridge cover, which is typically coated with granules such as crushed rock, is supported on a resilient surface 96, such as a soft rubber block. A tool 98 having the bending radius is pressed into the ridge cover 90 to bend the ridge cover along the ridge line 91. Preferably the rubber block 96 is a soft solid rubber about one inch thick. Preferably the tool 98 is a round steel bar about one-half inch in diameter. Preferably the tool is pressed into the ridge cover 90 about one-fourth of an inch after the tool makes contact with the inside surface 95 of the ridge cover 90. It is believed that this impact forming method of bending is advantageous because the resilient surface 96 supports the outer granule covered surface 93 and presses the granules into the outer surface during bending. This may improve the bonding of the granules to the asphalt composition material 92, particularly if the material is warm during the impact forming process, which provides a more durable material along the ridge line 91. It is also believed that the impact forming supports both surfaces 93, 95 of the material 92, 94 as it is bent to provide more uniform material properties of the bent region 91 after bending and thereby reducing discontinuities that cause stress concentrations that could develop into cracks and failures.

It will be appreciated that performing ridge covers prior to installation allows the ridge covers to be formed from asphalt composition material that is warmed. Warming softens the asphalt material that impregnates the fibrous material and improves the pliability of the asphalt composition for subsequent bending and folding operations. The temperature of the asphalt composition material is typically elevated to above 150° F., preferably to between 180° F. and 220° F., for the bending and folding operations. It will be appreciated that heating the asphalt composition material to these temperatures and handling the heated material for bending and folding at the time of installation would be difficult. Thus there is a significant advantage to manufacturing and shipping a preformed asphalt composition ridge cover that requires only minimal bending during later installation.

Figure 2:
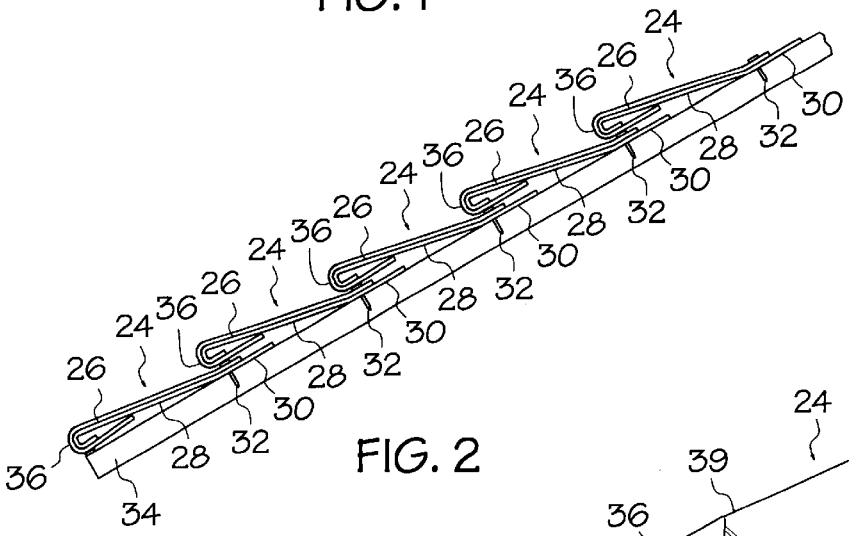
FIG. 2 is a cross section taken along line 2—2 of FIG. 1.

While an embodiment of the inventive ridge cover may be produced as described above from a single approximately rectangular sheet of roofing material with a single bend along the ridge line, such a ridge cover offers no aesthetic advantage. Embodiments of the inventive ridge cover that provide a thickened exposed end for an improved appearance are also possible. It may be seen that the ridge 20, hip 22, and rake 23 in FIG. 1 are characterized by a pleasant physical appearance as a result of the raising of the outward extending end of the ridge covers to provide an appearance more like a shake roof ridge cover. The manner in which this is achieved in the preferred embodiment is illustrated in FIG. 2, which is a cross section taken along line 2—2 of FIG. 1.

Each ridge cover 24 is comprised of a front end portion 26, a middle portion 28 and a back end portion 30. When folded, the ridge cover is approximately 11½ inches long and each side of the ridge cover is approximately 4 inches wide. When installed, the front end portion 26 of a second ridge cover 24 is placed over the back end portion 30 of a first ridge cover 24 so as to cover the nails 32 used to secure the first ridge cover at its back end portion 30 to the roof 34. Thus no nails 32 are left exposed. Typically, the front edge 36 of the second ridge cover 24 is set back approximately 8 inches from the front edge 36 of the first ridge cover. Successive ridge covers 24 are installed upward along a ridge 20 in a similar manner.

Figure 3:
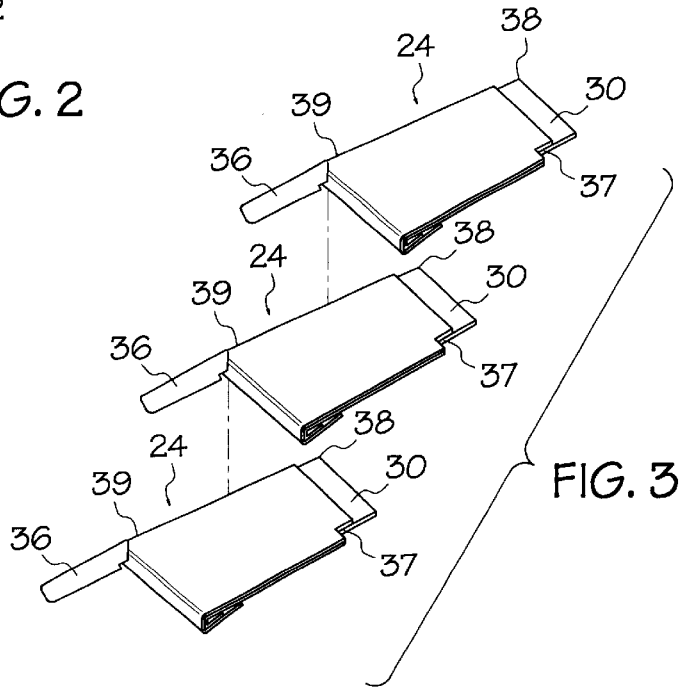
FIG. 3 is an illustration of three ridge covers shown in an exploded view to illustrate the manner in which each ridge cover is located with respect to another ridge cover.

A perspective of one embodiment of a finished ridge cover 24 is shown in FIG. 3 clearly illustrating the solid thickened front edge 36 of each ridge cover. A notch 37 is provided at each corner of the back end portion 30. The function of these notches 37 is partly cosmetic. Without the notch 37, the rear corners of a lower ridge cover would project sideways out from under the front edge 36 of the next ridge cover up the ridge. The notch 37 eliminates the unappealing projections. The notch 37 also serves as a guide to the roofer as to how far one ridge cover should overlap the other i.e., the distance from notch 37 to the front edge 36 is about 8.2 inches. The front edge 36 of one ridge cover should be installed so that it sits on the lower ridge cover at the lower end of a notch 37. This notch 37 eliminates the need for the roofer to measure, gauge or estimate overlap. The resulting overlap is uniform along the entire ridge 20.

The thickness of each ridge cover 24 gradually decreases toward the back end portion 30 where the ridge cover 24 is as thick as a single sheet of conventional asphalt composition material. A ridge bend 39 in the ridge cover 24 of approximately ninety degrees is located along the longitudinal centerline 38 of each ridge cover. The ridge bend 39 gives the ridge cover 24 a pleasing appearance and permits the ridge cover to straddle the ridge 20 of the roof 34 and also lie in contact with the roof on both sides of the ridge 20. The angle between the two sides of the ridge cover 24 may be adjusted during installation so that the ridge cover fits closely to the roof. It is preferred that the ridge cover is fabricated with an angle that is slightly more acute than required for the typical roof so that the adjustment is typically one of opening the ridge cover to a more obtuse angle and thereby reducing the tension in the outer surface in the area of the ridge bend 39. This tends to reduce the occurrence of cracking along the ridge bend 39. The ridge cover 24 is stored and shipped with the approximately ninety degree ridge bend 39 along the centerline 38. Ridge covers 24 can be stacked in a nested fashion in alternating directions so that the front portion 26 of one ridge cover 24 is stacked on top of the back end portion 30 of the next ridge cover 24. Ridge covers 24 so stacked are largely self protecting and only minimal additional packaging is required to hold them together for storage or shipping.

Figure 11:
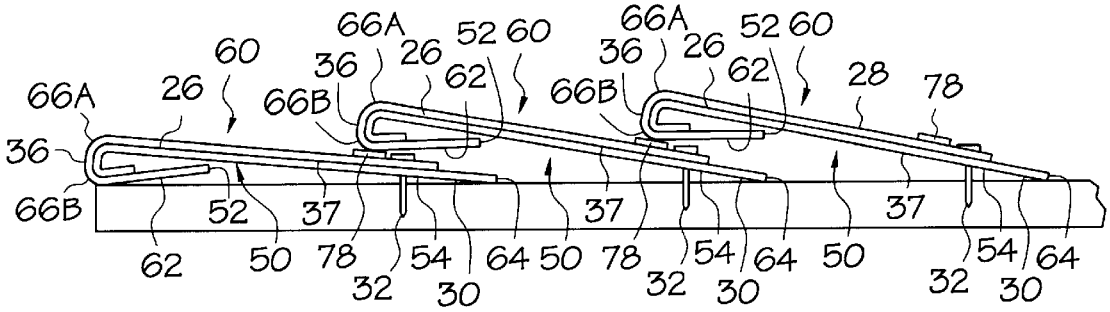
FIG. 11 shows the installation of the preferred embodiment of the ridge cover of the present invention.

The detailed cross sectional view of the ridge cover 24 in FIG. 11 shows the manner of providing increased thickness at the front end portion 26. The manner of assembly and folding provides for four thicknesses reducing to three thicknesses at the front end portion 26, two thicknesses in the middle portion 28 and a single thickness at the back end portion 30. A smooth curved front edge 36 is also provided by reason of the folding method disclosed herein.

Figure 4A:
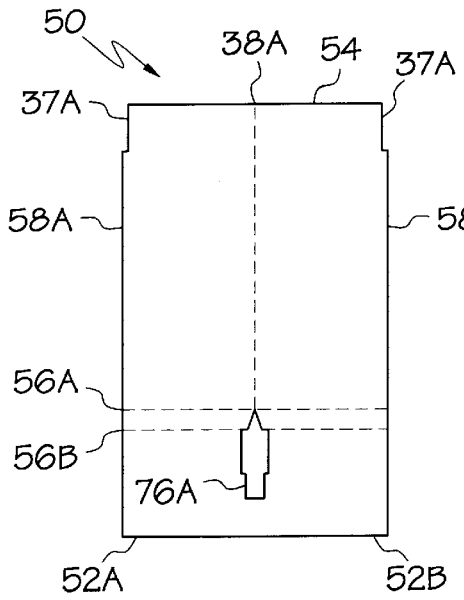
FIG. 4 shows the configuration of the pieces used to fabricate a ridge cover of the present invention.
Figure 4B:
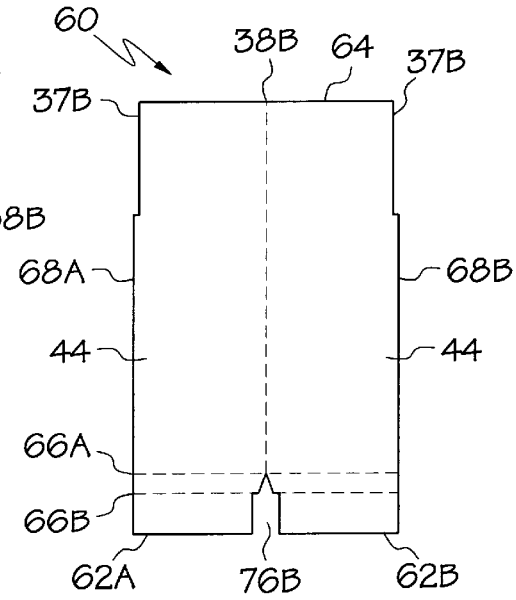

Each ridge cover 24 is fabricated from two generally rectangular pieces of roofing material, a top piece 50 and a bottom piece 60, which may be seen in plan view in FIG. 4*a* and 4*b*. Both pieces 50, 60 have the same general configuration including two foldable tabs 52*a*, 52*b*, 62*a*, 62*b*, at one end 56, 66 of the central portion of the piece 50, 60 and a central tab defined by notches 37*a*, 37*b* at the opposite end of the central portion. The foldable tabs 52*a*, 52*b* of the top piece may be joined where they meet along the centerline in the vicinity of the edge of the roofing material as shown so that the tabs will not splay outwardly when installed. Each piece has a central notch 76*a*, 76*b* designed to permit folding as later described. The roofing material may be any generally flat, flexible material suitable for roofing applications including, but not limited to, asphalt impregnated felt composition, fiberglass materials, rubberized compositions, and composites with various modifiers to improve flexibility and durability. One or both pieces of roofing material may have a crushed rock surface.

Figure 5A:
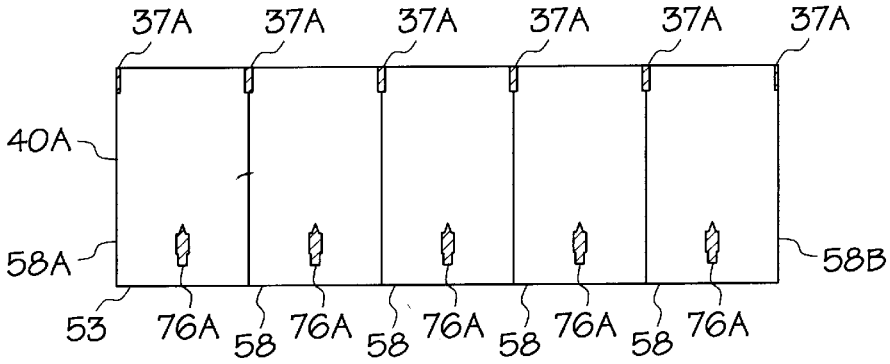
FIG. 5 is a rectangle of asphalt composition material showing the layout for cutting multiple ridge covers therefrom.
Figure 5B:
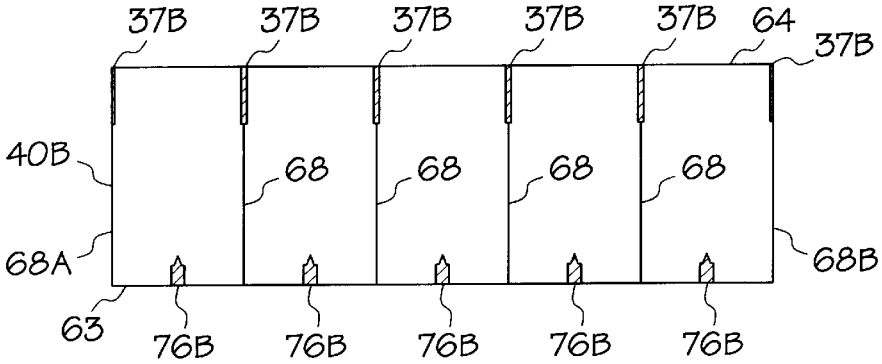

The top piece 50 and the bottom piece 60 are cut from the parent sheet 40. As shown in FIG. 5*a* and 5*b*, one particular embodiment of the invention allows five pieces 50, 60 to be efficiently cut from a parent sheet 40 that is a rectangle of asphalt saturated felt cut to an industry standard dimension of approximately 13¼ by 39¼ inches. The minimal waste material, shown by hatched lines in FIG. 5*a* and 5*b*, is cut away, such as by die cutting. Fabrication of the ridge cover 24 is preferably carried out with the asphalt composition roofing 40 at an elevated temperature, preferably about 200° F., to allow bending without cracking.

Figure 6:
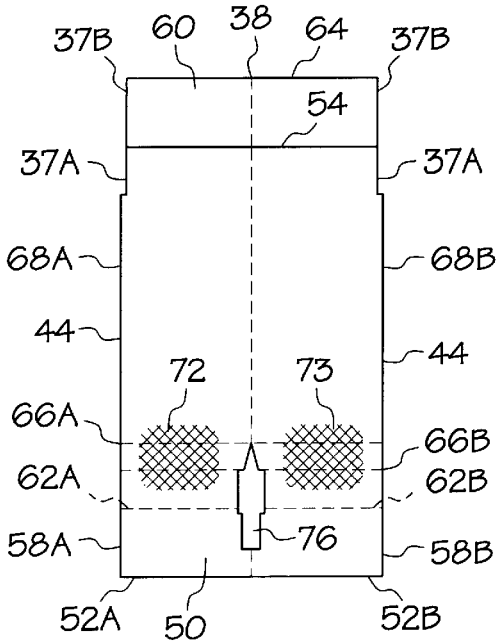
FIG. 6 shows the configuration of the unfolded ridge cover of the present invention.

Adhesive is applied to the underside of the top piece 50 substantially in the locations shown by cross-hatching 72, 73 in FIG. 6. It has been found to be desirable not to allow adhesive to extend into the areas adjacent to the ridge bend 39. It is believed that adhesive in the area of the ridge bend causes the ridge bend to be less pliable and introduces a stress concentration at the boundary of the adhesive thereby increasing the possibility of cracking when the ridge cover is adjusted during installation. Solid filler particles, such as ground rubber particles, may be added to the adhesive to increase the thickness of the assembly. A suitable filler can be made from used vehicle tires, crushed rock, cut scrap roofing material, or used roofing. One method for adding the solid filler is applying the adhesive to the piece, spreading solid filler particles over the piece, and then removing the loose particles. For example, loose particles may be removed by blowing air on the piece.

The top piece 50 is then assembled to the bottom piece 60 such that the sides 58*a*, 58*b*, 68*a*, 68*b* and notches 37*a*, 37*b* of the two pieces 50, 60 are substantially in alignment. The front ends 52, 62 and back ends 54, 64 may or may not be aligned. Preferably the front end 52 of the top piece 50 projects forward from the front end 62 of the bottom piece 60 by approximately 1 inch so that the front end 62 of the bottom piece 60 is captured by the front end 52 of the top piece 50. Preferably, the back end 64 of the bottom piece 60 projects rearward from the back end 54 of the top piece 50 by approximately 1 inch so that the back end of the ridge cover is a single thickness of material. In one embodiment of the method of fabrication, a plurality of top pieces 60 are joined to a like plurality of bottom pieces 50 and the following folding operations are preferably completed before individual assemblies are slit apart along the side lines 58, 68 shown in FIG. 5*a* and 5*b*.

Figure 7B:
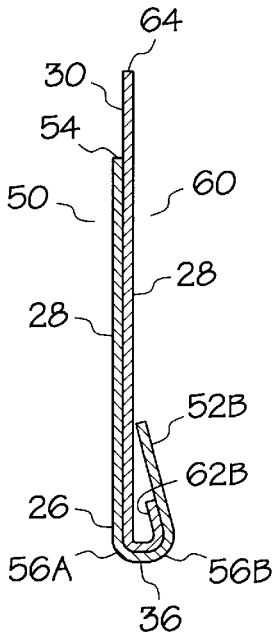
FIG. 7 shows the first folds made to the ridge cover of FIG. 6.
Figure 7A:
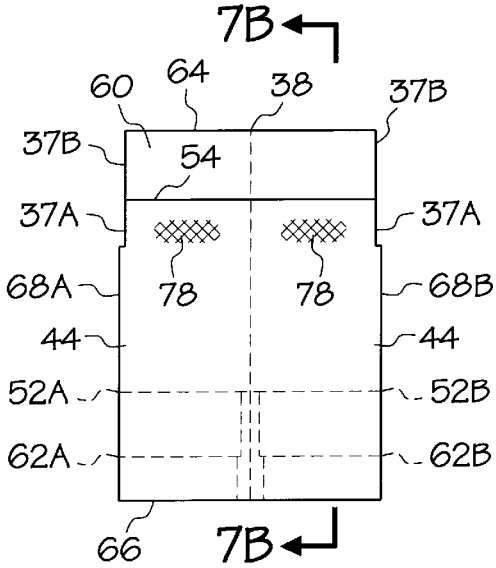
Figure 7C:
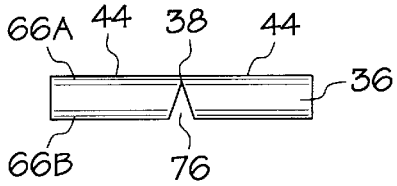

The foldable tabs 52*a*, 52*b*, 62*a*, 62*b* are folded over to form the thickened end 36 of the ridge cover as shown in FIGS. 7*a*, 7*b*, and 7*c*. After folding, the front edges of the foldable tabs 52*a*, 52*b* of the top piece 50 will be in contact or nearly in contact with the underside of the middle portion 28 of the bottom piece 60 as may be seen in FIG. 7*b*. The tabs may be bent at approximately ninety degrees along two crease lines 66*a*, 66*b* that are spaced apart by some distance, preferably ⅜ to ¾ of an inch, to form the front edge 36 of the ridge cover as may be seen in FIG. 7*b* and 7*c*. In the embodiment where a plurality of pieces have been folded while joined, the pieces are now slit apart to form a plurality of assemblies.

Figure 8:
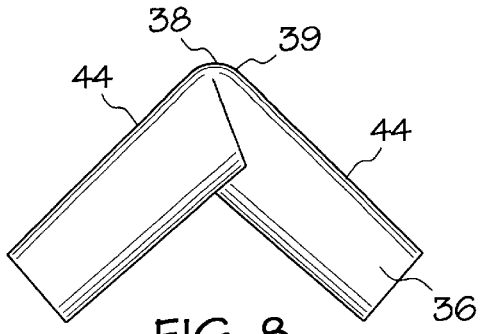
FIG. 8 shows the final fold made to the ridge cover of FIG. 6.

Finally, the assembly is bent to along the centerline 38, preferably through approximately ninety degrees, to form the ridge bend 39 as may be seen in FIG. 8. The ridge bend 39 is formed in substantially the same way as previously described for the embodiment produced from a single approximately rectangular sheet of roofing material. The bend is around a radius, preferably of approximately one-quarter of an inch. Preferably the bending and folding are done at elevated temperatures, preferably above 150° F. and more preferably between 180° F. and 220 F. Preferably the bending along the centerline 38 is done by the impact forming method described above.

Figure 10:
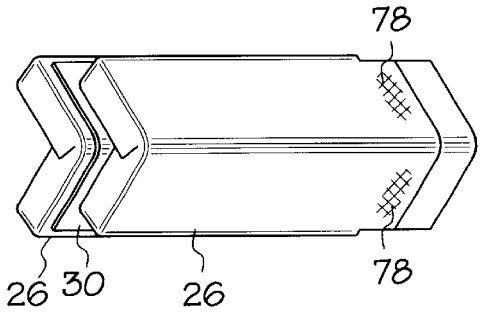
FIG. 10 is a drawing of three ridge covers in a stacked configuration for storage or shipping.

Once the final fold has been made and the ridge cover 24 has taken on the form shown in FIG. 8, the ridge cover 24 is prepared for shipment and installation. The unique method of fabrication produces a ridge cover 24 that is substantially rigid and largely self protecting. Finished ridge covers can be stacked in a nested fashion with the ridge bend 39 of one ridge cover 24 placed on top of the ridge bend 39 of the ridge cover 24 below as shown in FIG. 10. The ridge covers are stacked with the front portion 26 of one ridge cover 24 being stacked above the back end portion 30 of the ridge cover 24 below. In this way, the single thickness back end portion 30 of one ridge cover 24 is protected by the more rigid front portions 26 of the adjacent ridge covers 24. This arrangement also produces a straight stack by offsetting the tapers of the ridge covers 24. With this stacking arrangement, the finished ridge covers are inexpensively packaged for storage and shipment. It is desirable that the finished ridge covers be packaged in a manner that protects the ridge covers from changes in the preformed angle at the ridge line 38.

Figure 9:
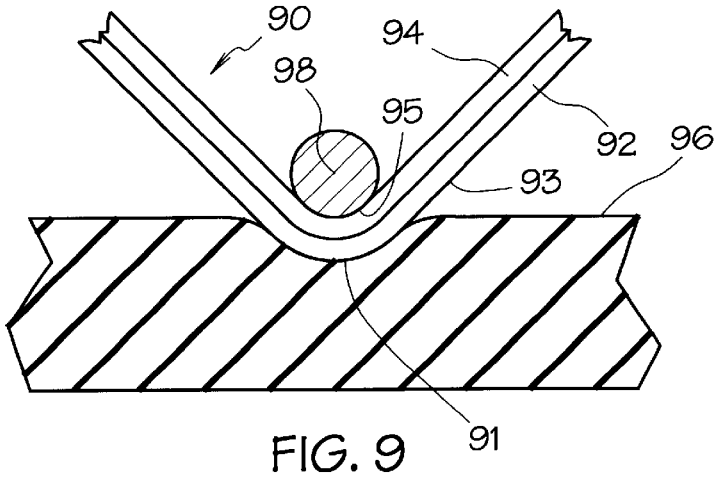
FIG. 9 is a cross section of a ridge cover during impact forming.

The rigidity of the ridge cover 24 created by the double thickness folded structure allows the ridge covers to be installed by nailing or stapling without use of adhesives. If desired, two regions of adhesive 74 may be used on the underside of the front end portion 26 as shown in FIG. 11. Such an adhesive 74 may be provided in the fabricated ridge cover by applying an adhesive 74 that will flow when heated by the sun's warmth to adhere the front end portion 26 of one ridge cover to the back end portion 30 of an underlying ridge cover as shown in FIGS. 8 and 9. A release film 75 may be applied to the adhesive 74, such as a release film in the form of a tape. The essential feature of the release film 75 is that it adhere to and yet be readily releasable from contact with the adhesive 74. The release film 75 is used to prevent the adhesive 74 from adhering to the back end portion 30 of an underlying ridge cover when in the packed position. The release film 75 is readily separated from the adhesive 74 prior to installation. Each ridge cover is secured by nails 32 as shown in FIG. 11. The nails are driven through the double thickness portion of the ridge cover 24 in the area that will be covered by the next ridge cover 24. The rear edge 54 of the central tab portion of the top piece 50 is located about 2 inches to the rear of the corner of the notches 37 to provide 2 inches of double thickness within which the nails should be driven.

There has thus been provided a novel preformed asphalt composition ridge cover where the bend along the ridge line is formed in a manner that reduces the susceptibility to cracking. While the description of the preferred embodiment has been with specific reference to FIGS. 1–11, it should be understood that various modifications, additions and substitutions may be made to the structure and method of the invention without departing from the spirit and scope of the invention as defined in the appended claims.

What is claimed is:

1. A ridge cover comprising:

a generally rectangular first sheet of roofing material having a first end, a second end, a first edge, a second edge, and a first central portion having a first longitudinal centerline;

a first foldable tab integrally formed with the first end extending from proximate the first longitudinal centerline to proximate the first edge and folded back upon the first central portion;

a second foldable tab integrally formed with the first end extending from proximate the first longitudinal centerline to proximate the second edge and folded back upon the first central portion;

a generally rectangular second sheet of roofing material having a third end, a fourth end, a third edge, a fourth edge, and a second central portion having a second longitudinal centerline, the second longitudinal centerline being adjacent to the first longitudinal centerline;

a third foldable tab integrally formed with the third end extending from proximate the second longitudinal centerline to proximate the third edge and folded back upon the first central portion; and a fourth foldable tab integrally farmed with the third end extending from proximate the second longitudinal centerline to proximate the fourth edge and folded back upon the first central portion;

wherein the first and second sheets of roofing material are bent around a radius along the first and second longitudinal centerlines.

2. The ridge cover according to claim 1 wherein the first and second sheets of roofing material are bent by pressing the roofing material into a resilient pad with a tool having the radius.

3. The ridge cover according to claim 1 wherein the first and second sheets of roofing material are bent while the roofing material is heated to at least 150° F.

4. The ridge cover according to claim 1 wherein the first and second sheets of roofing material are bent while the roofing material is heated to between 180° F. and 220° F.

5. The ridge cover according to claim 1 wherein the third foldable tab is joined to the first foldable tab, and the fourth foldable tab is joined to the second foldable tab.

6. The ridge cover according to claim 1 farther comprising an adhesive that joins the third foldable tab to the first foldable tab, and the fourth foldable tab to the second foldable tab and wherein there is no adhesive adjacent the first and second longitudinal centerlines.

7. The ridge cover according to claim 6 farther comprising solid filler particles mixed with the adhesive.

8. The ridge cover according to claim 7 wherein the solid filler particles include at least one of rubber particles, crushed rock, and ground roofing material.

9. The ridge cover of claim 1 further comprising the third foldable tab folded into contact with a first portion of the first central portion and the fourth foldable tab folded into contact with a second portion of the first central portion.

10. The ridge cover according to claim 1 wherein the lengths of the first and second foldable tabs are less than the lengths of the third and fourth foldable tabs.

11. The ridge cover according to claim 1 wherein the roofing material comprises asphalt composition material.

12. The ridge cover according to claim 1 wherein the roofing material comprises fiberglass material.

13. The ridge cover according to claim 1 wherein the roofing material comprises rubberized material.

14. The ridge cover according to claim 1 further comprising a first central tab integrally formed with the second end and having a width slightly less than the width of the first central portion and a second central tab integrally formed with the fourth end and having a width slightly less than the width of the second central portion.

15. The ridge cover according to claim 14 wherein the first and second central tabs are each provided with a pair of notches for indicating the required extent of overlap of one ridge cover by the adjacent ridge cover when installed on a ridge.

16. The ridge cover according to claim 14 wherein the first central tab is longer than the second central tab.

17. The ridge cover according to claim 1 wherein the first sheet of roofing material is substantially the same size as the second sheet of roofing material.

* * * * *